United States Patent [19]

Mol et al.

[11] 3,958,087

[45] May 18, 1976

[54] SWITCH STRUCTURE

[75] Inventors: Hans C. Mol, Wilton, Conn.; Martin G. Reade, Los Angeles, Calif.

[73] Assignee: Becton, Dickinson Electronics Company, San Juan Capistrano, Calif.

[22] Filed: Sept. 4, 1969

[21] Appl. No.: 855,226

[52] U.S. Cl. ..... 200/17 R; 260/11 TW; 260/153 P; 260/156; 200/293; 200/307

[51] Int. Cl.[2] ..... H01H 3/32; H01H 19/14; H01H 21/22

[58] Field of Search ..... 200/11, 11 TW, 11 D, 200/153.16, 155, 156, 11 R, 17 R, 18, 153 P, 155 R, 293, 307; 235/3, 9

[56] References Cited

UNITED STATES PATENTS

| | | | |
|---|---|---|---|
| 492,761 | 2/1893 | Desant | 235/9 |
| 1,865,883 | 7/1932 | Bornkessel et al. | 235/3 |
| 3,104,299 | 9/1963 | Koci | 200/156 |
| 3,182,141 | 5/1965 | Koci | 200/17 |
| 3,286,047 | 11/1966 | Heide | 200/11 |
| 3,375,337 | 3/1968 | Barrett | 200/156 |
| 3,499,127 | 3/1970 | Cherry | 200/153.16 |
| 3,504,139 | 3/1970 | Long | 200/11 TW |
| 3,555,211 | 1/1971 | Silverman | 200/11 TW X |

*Primary Examiner*—James R. Scott
*Attorney, Agent, or Firm*—Reed C. Lawlor

[57] ABSTRACT

An electrical switch is provided with a switch wheel having indicia appearing around the periphery of the switch wheel adapted to be presented to view through an aperture in a switch case as the switch wheel is rotated by a lever that projects through the wall of the switch case. The switch wheel rotates in accordance with the rotation of a lever-actuated switch plate with which the switch wheel is interconnected. Gears are provided interconnecting the switch wheel and the switch plate thereby allowing the switch wheel to be rotated through about 360° when the switch plate is rotated through a much smaller angle, such as about 90°.

24 Claims, 9 Drawing Figures

FIG. 3.
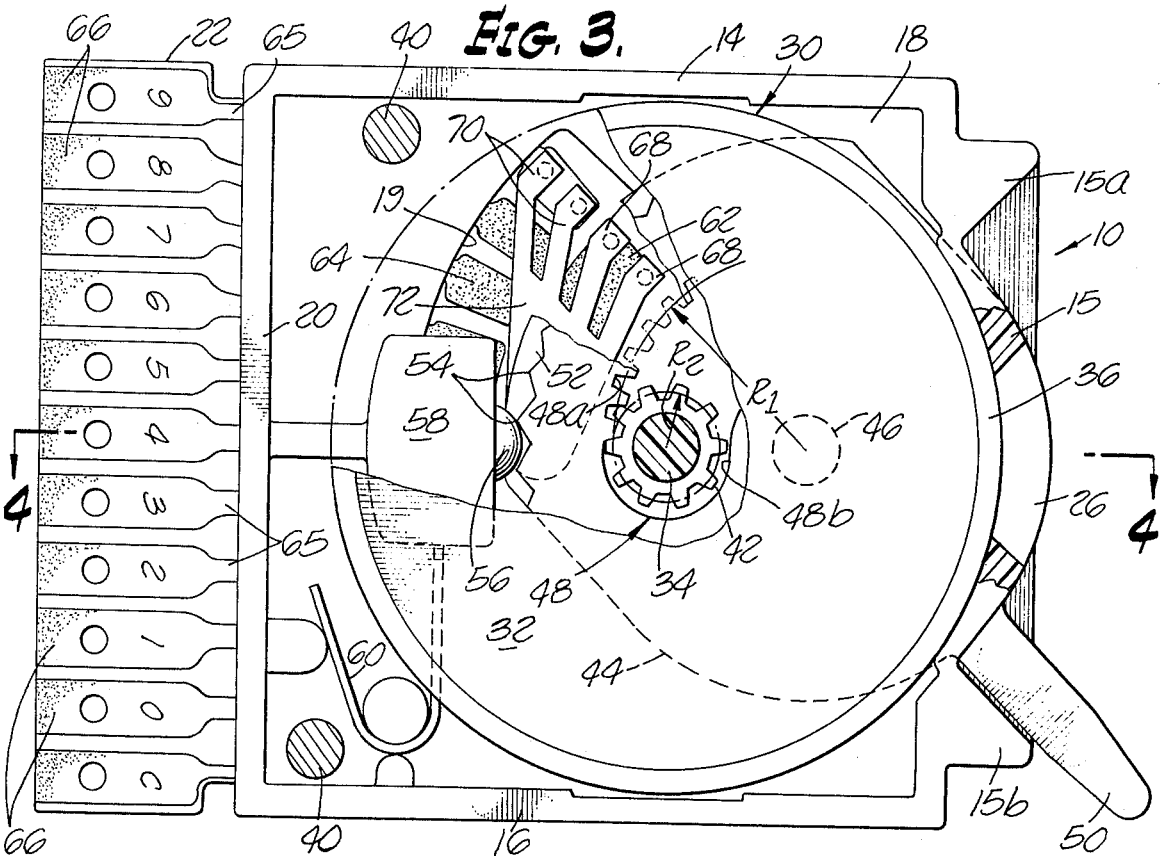
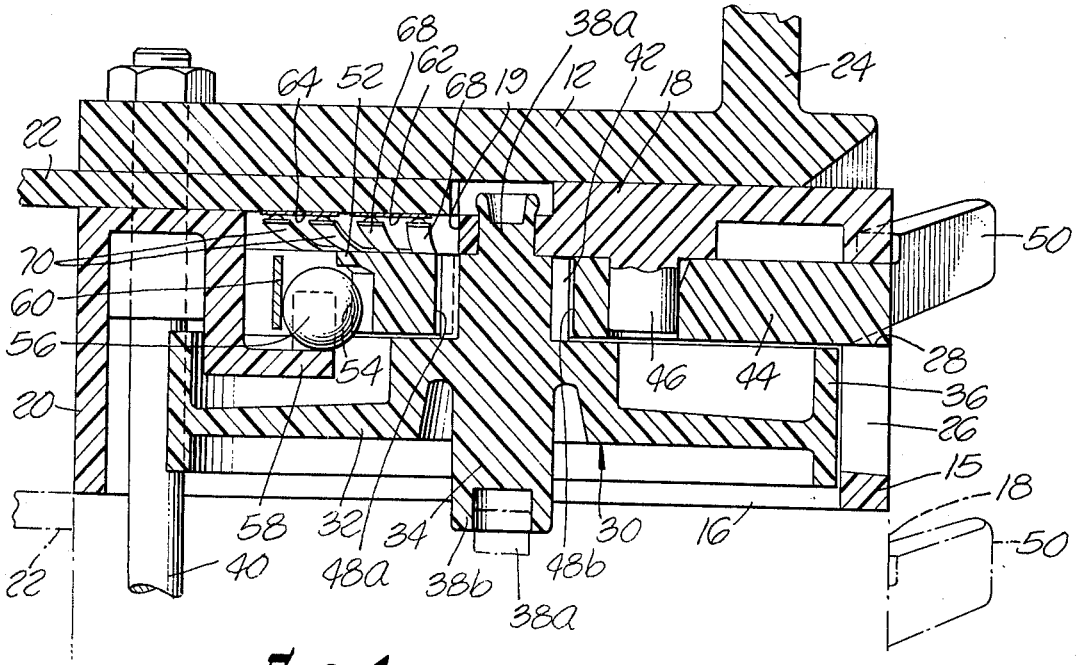
FIG. 4.
INVENTORS.
HANS C. MOL
MARTIN G. BEADE
BY
ATTORNEY

INVENTORS.
HANS C. MOL
MARTIN G. READE
BY
ATTORNEY

SWITCH STRUCTURE

BACKGROUND OF THE INVENTION

This invention relates to switching devices which may be constructed as a plurality of assembled units that are manually actuable to operate electrical switching means in each unit. As a result of the operation of the switching units, appropriate corrections are made to electronic instruments for whatever purpose is required.

Many of the switching devices presently employing electrical switching means utilize thumb-wheels, such as star wheels or serrated wheels, having indicia printed on a cylindrical rim, on protrusions, in grooves, or in between serrations on the periphery of the thumb-wheels. The thumb-wheels are rotatably mounted in an apertured switch case so that an indicium on the thumb-wheel may be viewed through the aperture. These thumb-wheels are rotated by the user's finger pressing on protrusions or serrations on the periphery of the thumb-wheel. As the thumb-wheel is rotated, electrically conductive wipers mounted on the thumb-wheel rotate and contact various electrical contacts, thereby forming various electrical circuits corresponding to the indicium appearing on the thumb-wheel through the case aperture.

It has become apparent through the use of such thumb-wheel switches that a more accurate and less tiring type of switch is desirable where frequent settings of the switch are required. The user of these thumb-wheel switches, in order to rotate the thumb-wheel, usually covers the indicia on the periphery of the thumb-wheel with his finger. Such covering of the indicia makes it difficult for the user to accurately position the thumb-wheel in order to quickly form the desired circuit. This affects both the accuracy of the thumb-wheel switch and the rapidity with which the various circuits corresponding to the indicia can be completed. Further, the finger of the user, after frequently operating a thumb-wheel switch for a number of hours, becomes tired due to the pressure required to rotate the thumb-wheel. Also, the pad of the user's finger usually becomes sore due to frequent contact with the protrusions or serrations on the thumb-wheel. This impairs the user's efficiency and thus the efficiency of the switch.

We have discovered that by providing a lever actuated switch interconnected with an indicia-carrying switch wheel, the accuracy and speed of operation of such an electrical switch can be improved to a considerable extent. Also, the comfort of the frequent user of the switch can be improved.

SUMMARY OF THE INVENTION

The switch structure of this invention comprises a switch case having an aperture in the face wall of the case and electrical contacts mounted on the case. An indicia carrying switch wheel is mounted for rotation in the case behind the aperture in the face wall of the case, so that a selected indicium may be presented to view through the aperture in the case as the switch wheel rotates in the case. Switch means are rotatably mounted in the case and are adapted to contact electrical contacts as the switch means is rotated, thereby completing a plurality of different electrical circuits. A lever is connected to the switch means and protrudes through the aperture in the face wall of the case so that the switch means may be actuated by means of force applied to the lever. Conversion means are also provided so that the switch wheel will rotate through a large angle, such as a large angle greater than about 270°, as the switch means is rotated through a much smaller angle, such as 90°.

The foregoing and other advantages, features, and characteristics of this invention are described below and will be apparent to those skilled in the art upon reference to the following specification and the accompanying drawings wherein certain embodiments are disclosed to indicate what is presently deemed to be the best manner of constructing and employing the invention.

In the drawings:

FIG. 3 is a partly sectional side elevational view of the embodiment of this invention;

FIG. 4 is a cross-sectional plan view of the embodiment of this invention;

CASING STRUCTURE

Figure 1:
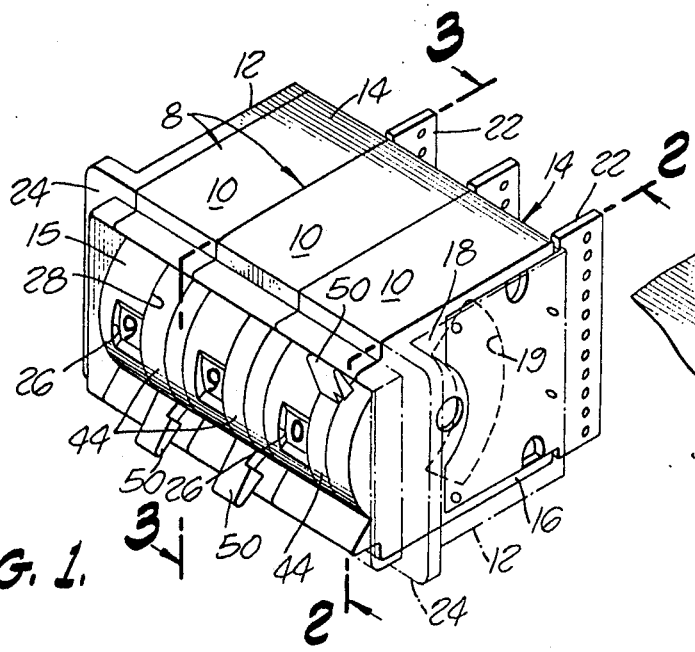
FIG. 1 is a perspective view of a series of switch units of this invention mounted together.

As shown in FIG. 1, three switch units 8, which are identical in construction, are assembled for the purpose of performing in-line counting operations up to 990. At each end of the assembly of the three switch units 8, there is provided an aligned end plate 12, retained in assembled position by the same means which retain the switch units 8 in assembled position, as more fully described hereinafter.

Figure 5:
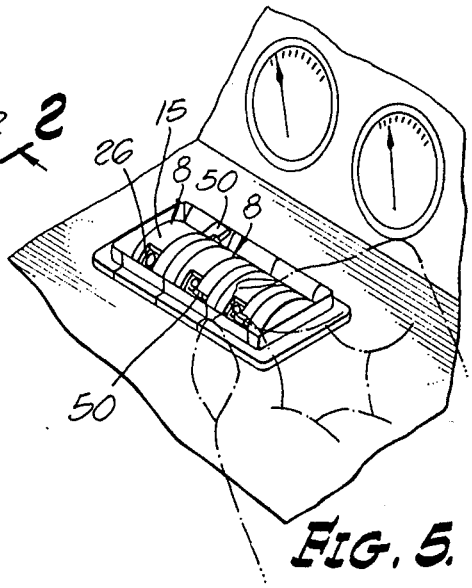
FIG. 5 is a perspective view of another series of switch units of this invention mounted together.

The case 10 of each switch unit 8, as the assembly of FIG. 1 is viewed in perspective, includes a top wall 14 which is relatively narrow as compared with its length, a curved front wall 15, and a bottom wall 16, these having the same narrow configuration as the top wall. The front wall 15 is provided with a generally rectangular window 26 and an elongated slot 28, as is shown in FIGS. 1 and 5. In FIG. 1, the window 26 is in the center of front wall 15. In the best embodiment of the invention, the front wall 15 is curved in order to conform to the curvature of the switch wheel 30 which is rotatably mounted within the case 10. The window 26 provides a means by which indicia carried on the switch wheel 30 may be viewed from outside of the case.

Stops or lips **15*a* and 15*b* are formed integrally with the front wall 15 to provide stops for the lever 50**, as will be explained hereinafter.

Figure 2:
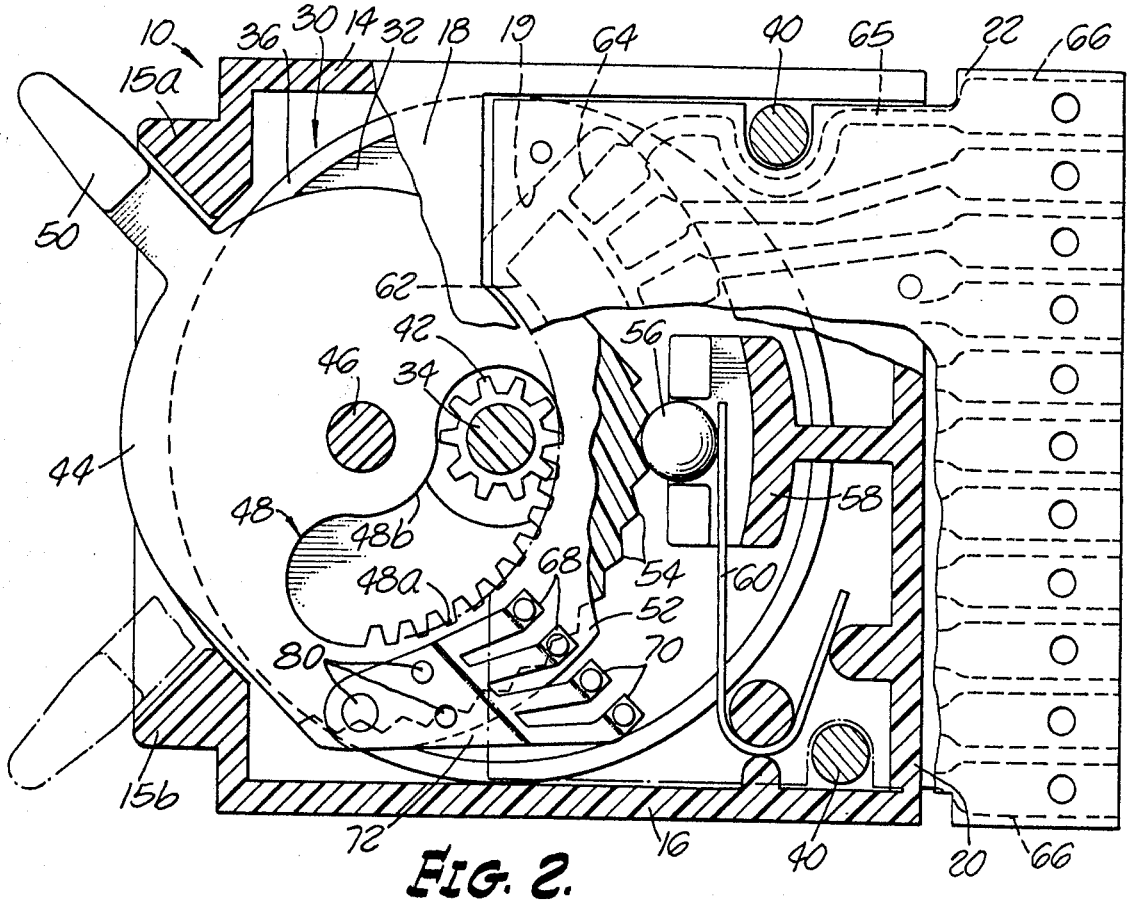
FIG. 2 is a partly sectional side elevational view of an embodiment of this invention.

Each case 10 has a side wall 18, extending the height and length of the casing, and a back wall 20, as seen in FIGS. 2 and 3, which is somewhat narrower than the walls 14, 15, and 16, to provide a narrow, slot-like space for reception between the walls 14 and 16 of a projecting rearward end of a circuit board 22, as presently to be more fully described. The side wall 18 is indented for approximately the rearward one-half of the length of the side wall 18 in order to provide the slot-like space in cooperation with the back wall 20 for reception of the circuit board 22. The side wall 18 also has an aperture 19 extending through its width in order to provide access to the circuit board 22 from the interior of the case 10.

A mounting plate for the case 10 is formed integrally with the end plates 12 by means of outwardly directed flanges 24. The height of flanges 24 is the same as the height of front wall 15. The flanges 24 are bored at their ends in order to provide apertures through which bolts or screws may pass in order to mount the switch unit 8 on a console or the like, as is shown in FIG. 5. The end plate flanges 24 have lips corresponding to the stops 15*a* and 15*b* of the front wall 15. The end plate lips traverse the flanges 24 in both the horizontal and vertical direction in order to form a ridge continuous with the stops 15*a* and 15*b* across the top, bottom and sides of the entire switch unit assembly. This combination of lips and stops provides a raised ridge on the front of the switch assembly which sets off the face of the switch units 8 from their surroundings.

All of the described case wall portions may be integral with one another, as conveniently provided by molded thermosetting or thermoplastic construction. The end walls 12 may also be of thermosetting or thermoplastic construction.

SWITCH WHEEL

Each switch wheel 30 includes a body section 32 which extends radially outward from a central hub section 34, as shown in FIG. 4. A cylindrical rim 36 of the switch wheel 30 carries a series of indicia as indicated in FIGS. 1 and 5. The rim 36 rotates behind the window or aperture 26 so that, as each indicium is moved into position, it is viewed through the window 26.

The hub portion 34 of the switch wheel 30 is centrally provided with a male connection 38*a* at one end of the hub, and a female connection 38*b* at the opposite end of the hub. These connections may be integral with the hub 34, especially where the entire switch wheel 30 is cast or molded as one unit from thermosetting plastic or the like. The male connection 38*a* may be journaled in a bore providing a bearing, such as a bore in the side wall 18 as best illustrated in FIG. 4. The male connection 38*a* has a central hollow portion and a flared periphery in order that the male connection 38*a* may be forced through the smaller bore in side wall 18 and be held in the bore by the flared periphery. The female connection 38*b* is adapted to receive a male connection 38*a* from a switch wheel 30 of an adjacent switch unit 8. The female connection 38*b* may be journaled in an enlarged bore adjacent male connection 38*a* in the side wall 18 at an adjacent switch unit 8. The end plates 12 are secured to the outside of a case 10 or to the two ends of a series of cases 10 by screws or bolts 40 which extend entirely through each case 10 and through the end plates 12, as shown in FIGS. 1 and 4. These bolts 40 are positioned in bores located in appropriate corners of the cases 10, as best illustrated in FIGS. 1 and 4.

GEARING

A pinion gear 42 is mounted on the hub 34, as best shown in FIGS. 2 and 3. In the best embodiment of the invention, the pinion gear 42 is integrally molded with the switch wheel 30 from thermosetting plastic or the like.

An apertured switch plate or lever plate 44 is rotatably mounted in the case 10 on an offset bearing 46, which bearing is formed as part of the case sidewall 18. The switch plate 44 is formed with a curved, elongated aperture 48 which extends through the thickness of the switch plate 44. The switch plate aperture 48 is of a configuration suitable for receiving the pinion gear 42, so that as the switch plate 44 is rotated on the offset bearing 46, the pinion gear 42 will be maintained within switch plate aperture 48. Either the outer edge 48*a* or the inner edge 48*b* of the aperture 48 may be provided with gear teeth adapted to mesh with the gear teeth of the pinion gear 42. In the best embodiment of this invention, the switch plate gear teeth are formed on the outer edge 48*a* of the switch plate aperture 48 in order to provide the maximum mechanical advantage for rotating the pinion gear 42. This enables the size of the switch plate to be minimized.

As shown in FIG. 3, the geared edge 48*a* of the switch plate 44 is curved about the bearing 46 such that the ratio of the radius R1 of the pitch circle of this curve to the radius R2 of the pitch circle of the pinion gear 42 will enable the pinion gear and the switch wheel to rotate through a large angle when the switch plate is rotated through a much smaller angle. More specifically, this invention allows the switch wheel to be rotated through an angle greater than about 270° when the switch plate is rotated through about 90°. This is accomplished by providing a ratio of R1 to R2 of about 3 to 1 or greater. For example, in one embodiment of this invention, the pinion gear 42 has a pitch radius R2 of 0.0845 inches and the geared edge 48*a* has a pitch radius R1 of 0.305 inches. Both the pinion gear 42 and the switch plate are provided with 10 gear teeth. Such a configuration will allow the pinion gear to rotate through about 324° when the switch plate is rotated through about 90°.

The most economical use of the switch wheel 30 occurs when indicia are printed on the full 360° circumference of the switch wheel. In this manner, the smallest switch wheel can be used. An angle of rotation of the switch plate 44 of about 90° has proven most satisfactory since a substantially smaller angle makes rapid positioning of the switch plate difficult and a substantially larger angle makes hand operation of the switch awkward in that it becomes necessary to reach above or below the switch where visibility may be poor in order to actuate the switch.

LEVER

A lever 50 is integrally mounted on the switch plate 44. The switch plate or lever plate 44 is rotatably mounted within the case 10 on the bearing 46 such that the lever 50 protrudes outside of the case 10 through the case slot 28. In the best embodiment of this invention the lever 50 is angled or slanted towards the case sidewall 18 and away from the case window 26, as shown in FIG. 4. In order not to interfere with the reading or operation of adjacent switch units in an assembly, which assembly will be described hereinafter, the lever 50 terminates within the cross-sectional area of the case 10, as is shown in FIG. 4. In other words, the lever 50 slants towards but does not extend beyond sidewall 18. The lever 50 is of sufficient length to be grasped between two fingers of a person desiring to operate the switch, as is shown in FIG. 5. The lever 50 is also of sufficient length to engage stops 15*a* and 15*b* when the switch wheel 30 is rotated to one end or the other of its scale.

Thus, a lever-operated switch plate 44 is provided which is interconnected with the switch wheel 30 such that the switch plate 44 may be rotated by pressure applied to the switch plate lever 50. At the same time, the angle of the switch plate lever 50 allows the fingers or other means to apply such pressure without interfering with the viewing of the indicia on the rim 36 of the switch wheel 30 visible through the case window 26. Such lever operation is made practical due to the gearing ratios previously described. In this manner, a user of the switch may complete various circuits corresponding to the indicia printed on the full 360° circumference of the switch wheel 30 by moving the lever 50 through a much smaller angle.

The upper and lower stops 15*a* and 15*b* on the case front wall 15 are formed such that their edges which contact the switch plate lever 50 are tangential to the contacting edge of the switch lever 50 in order to provide an elongated stop for the lever 50. This provides a limit for the maximum rotation of the switch plate 44.

RESILIENT STOP

Switch plate 44 is formed with a lip or shelf 52 and detent means or a series of notches 54 on its rearward periphery. The notches 54 provide means for indexing the various positions which the switch plate 44 and the switch wheel 30 may assume. Other detent means, such as a ball or other roller 56 is supported on mounting block 58 and is resiliently held in contact with the lip 52 and notches 54 by means of a U-shaped leaf spring 60 mounted in the case. The mounting block 58 is formed integrally with the case rear wall 20. The resiliently held ball 56 provides a resilient stop or ratchet by which the switch plate 44 may be temporarily held in a desired position against slight pressures and vibrations when the ball 56 is seated within a notch 54. Thus, when the switch plate 44 is rotated to bring an indicium into view in the case window 26, the ball 56 settles down into the notches 54 corresponding to such indicium and retains the switch plate 44 and the switch wheel 30 in the new position. For some uses, this resilient stop mechanism might be omitted. However, use of this resilient stop mechanism is preferred since it provides a more positive holding action, especially when the switch is subjected to vibration or shock forces. It will be noted that the switch plate 44 may be rotated through a number of positions in either the clockwise or counterclockwise directions, thus enabling the user to rotate the switch wheel 30 either clockwise or counterclockwise from one end of its scale to the other without stopping. The switch wheel 30 may be stopped at any intermediate point on its scale.

In the thumbwheel type switches, the user must raise his finger away from the thumbwheel in order to check that the desired indicium is in position in the case window. The device of this invention overcomes this and other inefficiencies by providing a lever actuated switch plate 44 which may be continuously or intermittently rotated through various positions while at the same time allowing the ten indicium appearing on the 360° rim of the switch wheel 30 to be viewed through the case window 26.

ELECTRICAL CONNECTIONS

The function of the switch means or wiper 72 is to make and break circuits corresponding to the indicia on the rim 36 of the switch wheel 30 which appear in the case window 26. This is accomplished through the medium of the above mentioned printed circuit board 22 and a switch means or wiper 72 mounted on either the switch plate 44 or on the switch wheel 30 or both in position to make or break circuits by means of contacting members on circuit board 22. These alternative embodiments will be explained more fully hereinafter.

Figure 6:
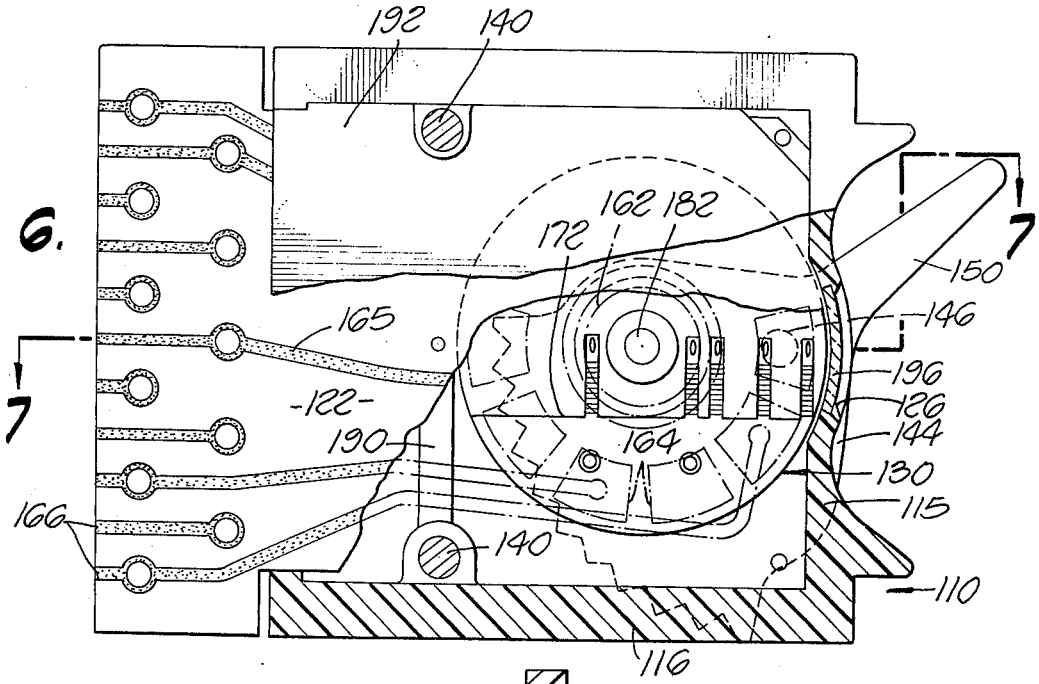
FIG. 6 is a partly sectional side elevational view of another embodiment of this invention.

As is shown in FIGS. 2 and 3, the circuit board 22 includes contacts to be engaged by the wiper 72. A continuous curved contact segment 62 is provided on the circuit board adjacent to the hub 34 of the switch wheel 30. This continuous contact segment 62 is called a common contact. There is also provided a series of radially extending printed contact segments 64 spaced from each other and corresponding respectively to the indicia printed on the rim 36 of the switch wheel 30. Printed leads 65 extend from the contact 62 and the various contacts 64 to appropriate terminals 66 at the projecting end of the circuit board 22. The terminals 66 may be wired into any instrument with which the switch is to be used. All of the contact segments, leads and terminals are disposed on one side of the circuit board 22, which is formed of insulating material. However, various of the leads 65 could be disposed on the opposite side of the board 22 with appropriate through connections extending through the board from some of the contact segments 64 to the leads 65 and back through the board 22 to the terminals 66, as is shown in FIG. 6 and as will be described more fully hereinafter.

As is shown in FIGS. 2 and 3, the wiper 72 is secured to the switch plate 44 adjacent to the circuit board 22 by means of swagged integral pins 80 or the like. The wiper 72 has a pair of inner wiper fingers 68 and a pair of outer wiper fingers 70. The make and break fingers 70 and 68 of the wiper 72 are positioned to contact the successive contact segments 64 and the common contact segment 62 on the circuit board 22 through the aperture 19 in the case sidewall 18 as the switch plate 44 is rotated. The inner wiper fingers 68 are positioned to contact the common contact segment 62 as the switch plate 44 is rotated. The outer wiper fingers 70 are positioned to successively contact the segments 64 as the switch plate 44 is rotated. The wiper 72 and the wiper fingers 68 and 70 are integrally formed of an electrically conductive material, such as gold or the like.

OPERATION

In the position of the switch wheel shown in FIG. 3, the inner wiper fingers 68 are in contact with the common (*c*) contact 62 and the outer wiper fingers 70 are in contact with one of the successive contact segments 64. As shown in FIG. 3, such contact 64 is the contact segment designated by the number or digit 9 on the corresponding terminal 66. In such a position, this switch, when wired into an instrument, would close a circuit corresponding to a circuit attached to the terminals 66 designated by C and 9. (See FIG. 3.) Further, the particular indicium on the switch wheel rim 36 appearing in the case window 26 would be the number 9.

With the mechanism thus described, as the switch wheel 30 is rotated in accordance with the rotation of the switch plate 44 to present the indicia on the switch wheel 30 successively to view in the window 26, corresponding circuits are completed through the circuit board 22, the contacts thereon, and wiper fingers 68 and 70 of the wiper 72.

The electrical arrangement illustrated in FIG. 2, as has been previously indicated, is for use with a decimal circuit system. The present structure, however, also lends itself readily to the employment of a binary circuit arrangement. Such an arrangement would require some rearrangement of the wiper fingers 68 and 70, the contacts 62 and 64, and the terminals 65. Such an arrangement is well known to those skilled in the art.

In assemblying a plurality of switch units 8 and two end plates 12 into a complete assemblage such as is shown in FIGS. 1 and 5, the male and female ends 38*a* and 38*b* of the switch wheel hub 34 are arranged to interlock so that all of the case windows 26 of each switch unit 8 in the assemblage are in line. This arrangement provides an easy in-line readout of the indicia representing the circuits to which the individual switches are connected. Screws or bolts 40 are inserted through appropriate bores in the circuit boards 22, sidewalls 18, and end plates 12 in order to secure the entire assemblage together.

LOWER WINDOW

In an alternative embodiment of the invention shown in FIG. 5, the case windows 26 are positioned in the lower end of the case wall 15 so that when the switch units 8 are mounted with their front walls 15 in the horizontal plane, the user may easily read the indicium presented to view in the case windows 26. In this position, the switch user may rest the heel of his hand on the console on which the switch assembly is mounted and at the same time reach the switch levers 50 with his fingers in order to actuate the switch and present to view the desired indicium.

WIPER-CARRYING SWITCH WHEEL

Figure 7:
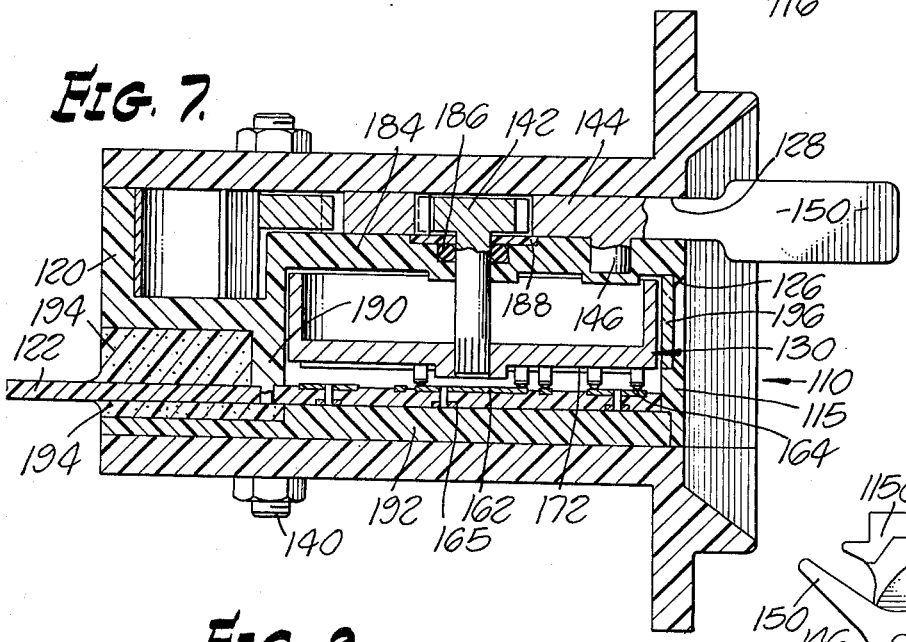
FIG. 7 is a cross-sectional plan view of the embodiment of this invention shown in FIG. 6.
Figure 8:
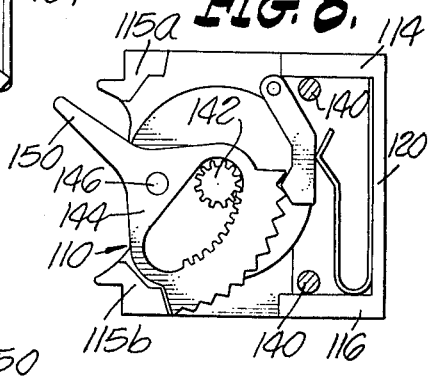
FIG. 8 is a cross-sectional elevational view of the embodiment of this invention shown in FIGS. 6 and 7.

An alternative embodiment of the invention is shown in FIGS. 6, 7, and 8 wherein a sealed switch is provided having a switch means or wiper 172 mounted on the switch wheel 130. In such an arrangement, the wiper 172 will rotate through about 324° with the switch wheel 130 when the switch plate or lever plate 144 is rotated through about 90°, by pressure applied to lever 150, as has been previously described. The movable wiper 172 is adapted to contact stationary electrical contacts on circuit board 122. Both the wiper 172 and the electrical contacts on circuit board 122 to be contacted by the wiper are mounted in a sealed electrical parts chamber in order to protect these electrical components from the deleterious effects of the atmosphere or the environment in which the switch is operating.

Circuit board 122 has a continuous annular common conductive contact segment 162 formed thereon and a series of conductive contact segments or pads 164 formed thereon around the circumference of and spaced from the common contact segment 162. As has been previously described, some leads 165 are disposed on the side of circuit board 122 adjacent the wiper 172, while other leads are disposed on the opposite side of circuit board with appropriate connections extending through the board from the contact segments 162 and 164 to leads 165 and back through the board 122 to the terminals 166. Such a circuit board arrangement allows the wiper 172 to alternately contact the various contact segments 164 while maintaining contact with common contact 162 as it is rotated through the 324° of the full rotation of switch wheel 130.

Since the wiper 172 may rotate through about 324°, a greater number of contact segments may be placed on the circuit board thus providing a switch which is adapted to connect a greater number of circuits than an arrangement in which the wiper 172 rotates through only about 90°. However, the strength of the connection between the switch wheel 130 to the lever plate 144 must be sufficient to bear the torque required to rotate the switch wheel 130 against the added drag or friction created by the wiper 172 contacting the circuit board 122.

Stops 115*a* aand 115*b*, shown in FIG. 8, are formed on the inner edge of the case front wall 115 and on the side of the intermediate wall 184 such that the edges of the stops are contacted by the lever plate 144 when the lever plate is rotated through a certain angle. This provides a limit for the maximum rotation of the lever plate 144 in each direction.

As may be seen in FIG. 7, the lever plate 144 and the switch wheel 130 are mounted on opposite sides of a continuous intermediate wall member 184 which extends completely across the length and height of the switch case 110 separating the window 126 from the lever slot 128. A pinion shaft 182 is journaled in a bore and counter bore through the intermediate wall 184. A pinion gear 142 and the lever plate 144 are mounted on one end of the shaft 182 and the switch wheel 130 is mounted on the opposite end of the shaft. The bore through the intermediate wall 184 is sealed around the shaft 182 by means of an O-ring 186 mounted in the counterbore with the bore 182. The O-ring is held in place by a doughnut-shaped bearing member 188 mounted in the bore between the pinion gear 142 and the O-ring 186. The shaft 182 passes through the center of the bore, the O-ring 186, and the bearing 188. The O-ring is larger than the depth of the counterbore. The pinion gear 142 and the switch wheel 130 are secured to opposite ends of the shaft 182 so that pressure is exerted against the sealing member 188. The O-ring 186 is compressed by such pressure until the sealing member 188 contacts the counterbore. The inside surface of the O-ring is thus squeezed against the shaft 182 to provide a seal in the bore through the intermediate wall 184. Other means known to those skilled in the art, such as are described, for example, in Lien U.S. Pat. No. 3,306,993, may be employed for sealing the bore.

A transverse retaining wall 190 transverses the intermediate wall 184 across the height of the switch case 110 adjacent the switch wheel 130. In this embodiment of the invention, the retaining wall 190 and the intermediate wall 184 are integrally formed, thus defining an electrical parts chamber bounded by the retaining and intermediate walls 190 and 184 and by the top, front, and bottom walls 114, 115, and 116 of the case 110.

Circuit board 122 is mounted on the case 110 opposite intermediate wall 184 across the remaining side of the electrical parts chamber adjacent switch wheel 130 so that the fingers of the wiper 172 may contact the contact segments on the circuit board. Face plate 192 is mounted on the switch case 110 on the side of the circuit board 122 opposite the switch wheel 130. Face plate 192 fits snugly against the interior of the front, top, and bottom walls, 115, 114, and 116 of the case 110. A plug 194, made of epoxy compound or the like, fills the pocket formed between the intermediate wall 184, the circuit board 122, and the retaining wall 190 and in the other pocket formed between the circuit board 122 and the face plate 192. The retaining wall 190 serves to keep the epoxy from running onto the electrical parts chamber before the epoxy hardens and fouling the switch wheel 130 in its operation. The plug 194 forms an airtight seal across the rear of one side of the switch case 110. In order to completely seal the wiper 172 and the adjacent portions of the circuit board 122 in the electrical parts chamber, window plate 196, constructed of glass or sheet plastic or the like, is secured across the interior of the window 126 and the face plate 192 is bonded to the walls of the case 110. The window plate 196 and the face plate 192 may be secured to the case 110 by means of a solvent or by ultrasonic welding or the like.

Thus, a switch structure is provided which includes a sealed electrical parts chamber, in which the electrical components are disposed, and an adjacent open unsealed space or chamber which communicates with the ambient atmosphere and contains a switch actuating means or lever plate 144, the switch wheel 130 within the sealed chamber having a packed or sealed driving connection with the lever plate 144.

DOUBLE WIPER

Figure 9:
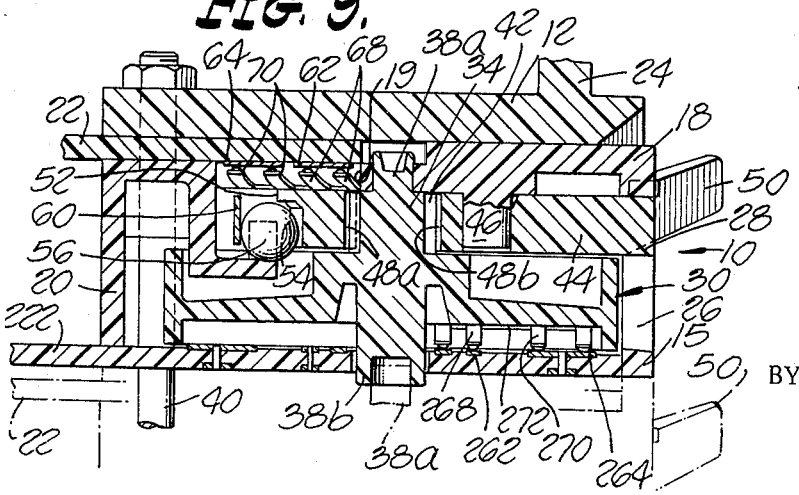
FIG. 9 is a cross-sectional plan view of another embodiment of this invention.

A further alternative embodiment of the invention is shown in FIG. 9 wherein a switch is provided which is identical with the switch shown in FIGS. 2, 3, and 4 previously described, except that a second switch means or wiper 272 is mounted on the switch wheel 30 in a position adjacent to a second circuit board 222, which second circuit board is similar in construction to the circuit board 122 previously described and shown in FIG. 7. The second circuit board 222 is mounted adjacent to the switch wheel 30 on the case 10. The wiper 272 is adpated to contact the circuit board 222 as it rotates with the switch wheel 30 through an angle of about 324°.

This embodiment of the invention provides an even greater capability of electrical circuit connection by each switch unit 8 since a larger number of electrical contacts are provided by the two circuit boards 22 and 222 mounted on each switch unit than is obtained by use of a single circuit board construction.

From the preceding discussion it is apparent that the switch units of the last two described embodiments of this invention are capable of being connected in an assemblage similar to that shown in FIGS. 1 and 5 which have previously been described.

From these disclosures, it is apparent that the switch of this invention is readily usable with a decimal or other display system in conjunction with any appropriate circuit system, whether this circuit system be decimal, binary, octal, or other usable system.

Although only four specific embodiments of the invention have been described, it will be obvious that the invention is not limited thereto but is capable of being embodied in many other forms. Various changes which will suggest themselves to those skilled in the art may be made in the material, form, details of construction and arrangements of the elements without departing from the scope of the invention.

The invention claimed is:

1. A switch structure comprising:

a case having an apertured face wall;

electrical contacts mounted on said case;

an indicia-carrying wheel having a plurality of indicia appearing around the rim of said wheel, said wheel being mounted for rotation in said case behind said aperture in order to present to view a selected indicium;

switch means mounted in said case adapted to selectively contact said electrical contacts as said means is rotated, thereby completing different electrical circuits in various switch positions;

a lever protruding through said aperture and being adapted to operate said switch means; and conversion means for rotating said wheel through a first angle as said lever is rotated through a second angle, said first angle being substantially larger than said second angle, said conversion means including means interconnecting said wheel and said lever for rotating said wheel clockwise about its axis when said lever rotates clockwise about its axis and for rotating said wheel counterclockwise about its axis when said lever rotates counterclockwise about its axis.

2. In a switch structure the combination of:

a case having first and second apertures in the face wall of the case;

means defining a sealed electrical parts chamber;

electrical contacts mounted on the case in the sealed chamber;

an indicia-carrying wheel having a plurality of indicia appearing around the rim of said wheel, said wheel being mounted for rotation in the case behind said first aperture in order to present to view selected indicium;

switch means mounted on the case in the sealed chamber adapted to selectively contact electrical contacts as said means is rotated, thereby completing any one of a plurality of different electrical circuits;

a lever protruding through said second aperture and being adapted to operate the switch means; and conversion means for rotating the wheel through a first angle as the lever is rotated through a second angle, said first angle being substantially larger than said second angle.

3. A switch structure as defined in claim 2 wherein the switch means is mounted on the wheel and the wheel is mounted in the sealed electrical parts chamber.

4. A switch structure as defined in claim 2 wherein said conversion means rotates the wheel through an angle greater than about 270° as the lever is rotated through an angle of about 90°.

5. A switch structure, comprising:

a case having an apertured face wall;

first electrical contacts mounted on said case;

an indicia-carrying wheel having a plurality of indicia appearing around the rim of said wheel, said wheel being mounted for rotation in said case behind said aperture and about an axis generally parallel to said face wall in order to present a selected indicium to view through said aperture;

switch means mounted in said case and comprising a support member that is rotatable about a second axis parallel to the aforesaid axis and second electrical contacts extending laterally from said support member and adapted to selectively contact said first electrical contacts as said support member is rotated, thereby completing different electrical circuits in various switch positions, the radius of movement of said second electrical contacts being smaller than the radius of movement of the outer extremity of said support member about said second axis;

a lever protruding through said aperture and being adapted to rotate said support member about said second axis; and conversion means for rotating said wheel through a first angle as said lever is rotated through a second angle, said first angle being substantially larger than said second angle.

6. A switch structure as defined in claim 5 wherein said conversion means rotates said wheel through an angle greater than about 270° as said lever is rotated through an angle of about 90°.

7. A switch structure as defined in claim 5, wherein said conversion means includes means interconnecting said lever and said indicia-carrying wheel whereby said wheel rotates clockwise about its axis when said lever rotates clockwise about its axis and said wheel rotates counterclockwise about its axis when said lever rotates counterclockwise about its axis.

8. A switch structure, comprising:

a case having an apertured face wall;

a first set of electrical contacts mounted on said case;

an indicia-carrying wheel having a plurality of indicia appearing around the rim of said wheel, said wheel being mounted for rotation in said case behind said aperture in order to present a selected indicium to view;

switch means mounted in said case on said wheel and adapted to selectively contact said first electrical contacts as said means is rotated, thereby completing different electrical circuits in various switch positions;

a lever protruding through said aperture and being adapted to operate said switch means;

conversion means for rotating said wheel through a first angle as said lever is rotated through a second angle, said first angle being substantially larger than said second angle;

a second set of electrical contacts mounted on said case;

a lever plate rotatably mounted on said case; and a second switch means mounted on said lever plate adapted to selectively contact said second electrical contacts as it is rotated, thereby completing different electrical circuits in various switch positions.

9. A switch structure comprising:

a case having an apertured face wall;

a first set of electrical contacts mounted on said case;

an indicia-carrying wheel having a plurality of indicia appearing on the rim of said wheel, said wheel being mounted for rotation in said case behind said aperture in order to present to view selected indicium;

first switch means mounted on said indicia-carrying wheel and being adapted to selectively contact said first electrical contacts as said first switch means is rotated, thereby completing any one of a plurality of different electrical circuits;

a second set of electrical contacts mounted on said case;

a lever plate rotatably mounted on said case;

second switch means mounted on said lever plate and being adapted to selectively contact said second electrical contacts as said second switch means is rotated, thereby completing any one of a plurality of different electrical circuits;

a lever protruding through said aperture and being adapted to operate said first and second switch means; and conversion means for rotating said indicia wheel to a first angle as said lever is rotated through a second angle, said first angle being substantially larger than said second angle.

10. A switch structure, comprising:

a case having an apertured face wall defining a window area;

a wiper-carrying lever plate rotatably mounted in the case on a first axis;

a lever formed integrally with the lever plate, said lever protruding through the window area and being adapted to operate the lever plate;

stops on the case adapted to limit the rotation of the lever plate;

an indicia-carrying wheel having a plurality of indicia appearing around the rim of the wheel, said wheel being mounted for rotation in the case behind the window area on a second axis in order to present a selected indicium to view through said window area;

gear means interconnecting the lever plate and said wheel and adapted to rotate the wheel through an angle greater than about 270° when the lever plate is rotated through a smaller angle;

stationary electrical contacts mounted on the case; and an electrically conductive wiper mounted on the lever plate between the outer edge thereof and said first axis, said wiper having electrical contact means adapted to selectively contact various of said stationary electrical contacts for completing a selected one of a plurality of different electrical circuits corresponding to the particular indicium visible through said window area.

11. A switch structure as defined in claim 10 further comprising:

means for indexing said wheel; and yielding means adapted to engage the indexing means in order to position selected indicium in said window area.

12. A switch structure as defined in claim 10 wherein said gear means comprises:

a first gear secured to the lever plate; and a second gear secured to the wheel and having a smaller diameter than the first gear, said second gear being adapted to mesh with the first gear and being so positioned and proportioned with respect to the first gear that the wheel rotates through an angle of about 360° when the lever plate is rotated through an angle of about 90°.

13. A switch structure as defined in claim 12 wherein the wiper-carrying lever plate has a curved, elongated aperture through its body, said drive gear being formed on the side of said lever plate aperture furthest from the axis of rotation of the lever plate, said pinion gear being adapted to rotate within said lever plate aperture and to mesh with said drive gear.

14. A switching system, comprising:

a plurality of substantially identical modular switch structure units, each switch structure unit comprising;

a case having an apertured face wall;

electrical contacts mounted on the case;

an indicia-carrying wheel having a plurality of indicia appearing around the rim of said wheel, said wheel being mounted for rotation in the case behind said aperture in order to present a selected indicium to view;

switch means mounted in the case adapted to selectively contact electrical contacts as said means is rotated, thereby completing different electrical circuits in various switch positions;

a lever protruding through said aperture and being adapted to operate the switch means;

conversion means for rotating the wheel through a first angle as the switch means is rotated through a second angle, said first angle being substantially larger than said second angle;

and means detachably holding said switch structure units assembled in side-by-side position to form compact switching assembly with the apertures of said face walls aligned for in-line viewing of a plurality of indicia.

15. In a digital switch:

a. a modular casing of rectangular configuration and having a height greater than its width and having an opening formed in its front wall and providing therein an interior cavity, b. a printed circuit plate positioned in said cavity, c. an actuator rotatably mounted within the cavity of the switch casing, d. means providing an axis about which said actuator is rotatably mounted within the cavity of the switch casing, said axis extending in the direction of said width, e. a position indicator for circuit-making contacts mounted within the cavity and movable about a second axis spaced from and parallel to said first mentioned axis, said position indicator having a peripheral portion exposed through the opening formed in the front wall of the casing, f. circuit-making contacts mounted within the cavity and movable over the printed circuit plate by rotatable movement of said actuator about its axis, g. cooperating means provided by said actuator for rotating the same in either direction about its axis for rotating said circuit-making contacts over the printed circuit plate, and h. means provided by said actuator extending out of a portion of the opening formed in the front wall of the casing and movable therethrough for rotating said actuator and said position indicator in either direction, and said circuit-making contacts over the printed circuit plate of the digital switch.

16. A digital switch as defined by claim 15 including an indexing means selectively positioning said position indicator in the opening formed in the front wall of the casing as the same is rotated inn either direction by said actuator.

17. A digital switch as defined by claim 15 wherein said means provided by said actuator extending out of a portion of the opening formed in the front wall of the casing and movable therethrough comprises an elongated lever extending in a plane transversely to the axes of said actuator and said position indicator, and adapted to be moved in either direction through the entire length of said portion of the opening formed in the front wall of the casing.

18. A digital switch as defined by claim 15 wherein said cooperating means provided by said position indicator comprises an externally geared hub, the teeth of which mesh with gear teeth provided by said actuator with the gear ratio therebetween being such that by movement of said actuator different portions of said position indicator are exposed in the opening formed in the front wall of the casing and said circuit-making contacts are moved into a predetermined position upon the printed circuit plate.

19. A digital switch as defined by claim 18 wherein said means provided by said actuator extending out of a portion of the opening formed in the front wall of the casing and movable therethrough comprises an elongated lever extending in a plane transversely to the axes of said actuator and said position indicator, and adapted to be moved in either direction through the entire length of said portion of the opening formed in the front wall of the casing.

20. In a digital switch as defined in claim 15, a switch member mounted on said actuator between the outer reach thereof within said cavity and supporting said circuit making contacts to extend therefrom toward said circuit plate to press thereagainst in a direction parallel to said first mentioned axis.

21. A digital switch as defined in claim 15, including means interconnecting said outwardly extending means and said position indicator whereby said position indicator rotates clockwise about its axis when said outwardly-extending means rotates clockwise about its axis and said position indicator rotates counterclockwise about its axis when said outwardly-extending means rotates counterclockwise about its axis.

22. In a digital switch:

a. a modular casing of rectangular configuration and having a height greater than its width and having an opening formed in its front wall and providing therein an exterior cavity, b. a printed circuit plate positioned in said cavity, c. an actuator rotatably mounted within the cavity of the switch casing, d. means providing an axis about which said actuator is rotatably mounted within the cavity of the switch casing, said axis extending in the direction of said width, e. a position indicator for circuit-making contacts mounted within the cavity and movable about an axis spaced from and parallel to said means providing an axis for said actuator, with said position indicator having a peripheral portion exposed through the opening formed in the front wall of the casing, f. circuit-making contacts mounted within the cavity and movable over the printed circuit plate by rotatable movement of said actuator, and said position indicator about their axes, g. cooperating means provided by said actuator and said position indicator for rotating the same in either direction about their respective axes for rotating said circuit-making contacts over the printed circuit plate, and h. means provided by said actuator extending out of a portion of the opening formed in the front wall of the casing and movable therethrough for rotating said actuator and said position indicator in either direction, and said circuit-making contacts over the printed circuit plate of the digital switch.

23. In a digital switch as defined in claim 22, a switch member mounted on said actuator between the outer reach thereof within said cavity and supporting said circuit making contacts to extend therefrom toward said circuit plate to press thereagainst in a direction parallel to said first mentioned axis.

24. A switching system, comprising:

a plurality of substantially identical modular switch structure units, each switch structure unit comprising:

a case having an apertured face well defining a window area;

a lever plate rotatably mounted in the case on a first axis;

a lever secured to the lever plate for operating the lever plate, said lever protruding through the window area;

a drive gear formed integrally with the lever plate;

an indicia-carrying wheel having a plurality of indicia appearing around the rim of the wheel, the wheel being mounted for rotation in the case behind the window area on a second axis in order to present selected indicium to view;

a pinion gear formed integrally with the wheel and having a smaller diameter than the drive gear, said pinion gear being adapted to mesh with the drive gear and being so positioned and proportioned with respect to the drive gear that the wheel is rotated through a first angle as the lever plate is rotated through a second angle, said first angle being substantially larger than said second angle;

stationary electrical contacts mounted on the case;

an electrically conductive wiper mounted on the indicia wheel between the rim thereof and said first axis, said wiper having electrical contact means adapted to selectively contact various of said stationary electrical contacts for completing a selected one of a plurality of different electrical circuits corresponding to the particular indicium visible through said window area;

detent means adapted to position a selected indicium in said window area;

stops mounted adjacent to each case face wall to limit the rotation of said lever plate;

and means detachably holding said switch structure units assembled in side-by-side position to form a compact switching assembly with the apertures of said face walls aligned for in-line viewing of a plurality of indicia.

* * * * *